US006973679B1

(12) United States Patent
Schad

(10) Patent No.: US 6,973,679 B1
(45) Date of Patent: Dec. 13, 2005

(54) PERSONAL CLEANSING SPRAY DEVICE

(75) Inventor: Jahan N. Schad, 376 Tharp Dr., Moraga, CA (US) 94556

(73) Assignee: Jahan N. Schad, Moraga, CA (US)

( * ) Notice: Subject to any disclaimer, the term of this patent is extended or adjusted under 35 U.S.C. 154(b) by 0 days.

(21) Appl. No.: 10/884,606

(22) Filed: Jul. 2, 2004

(51) Int. Cl.[7] ..... A47K 3/22
(52) U.S. Cl. ..... 4/420.4; 4/443
(58) Field of Search ..... 4/443, 444, 447, 4/448, 420.1, 420.2–420.5, 615

(56) References Cited

U.S. PATENT DOCUMENTS

| | | | | | |
|---|---|---|---|---|---|
| 523,941 | A | | 7/1894 | North | |
| 2,957,180 | A | * | 10/1960 | McMullen | 4/420.2 |
| 5,419,363 | A | | 5/1995 | Robinson | |
| 5,652,971 | A | * | 8/1997 | Wokas | 4/420.4 |
| 5,716,005 | A | * | 2/1998 | McMahan | 239/315 |
| 5,720,055 | A | | 2/1998 | Krist | |
| 5,987,659 | A | * | 11/1999 | Cannizzaro | 4/420.2 |
| 5,991,937 | A | * | 11/1999 | Safara | 4/420.2 |
| 6,397,406 | B1 | | 6/2002 | Moshkovich | |
| 6,473,913 | B1 | | 11/2002 | Bell | |
| 6,595,968 | B1 | * | 7/2003 | Perrino | 604/279 |
| D484,579 | S | | 12/2003 | Bennie | |
| D486,894 | S | | 2/2004 | Garza | |
| 6,704,946 | B1 | | 3/2004 | Mueller | |
| 2003/0220620 | A1 | | 11/2003 | McMurdo | |

* cited by examiner

*Primary Examiner*—David J. Walczak
*Assistant Examiner*—Huyen Le

(57) ABSTRACT

A personal cleansing device that is low in cost, simple to manufacture from standard components, that provides cleaning capabilities with water, and can provide a cleaning and antiseptic spray using a fluid-dispensing attachment. A water branch off valve is installed in flowable relation with the water supply line of a standard toilet. This valve supplies water to a flexible hose that may be retractable. This hose is connected to a manually operated sprayer nozzle having a trigger mechanism that may be used to turn the delivery of water on or off.

10 Claims, 3 Drawing Sheets

PERSONAL CLEANSING SPRAY DEVICE

FIELD OF THE INVENTION

The present invention relates to personal washing devices and, more particularly, to a bidet attachment for a toilet.

BACKGROUND OF THE INVENTION

Bidets are commonly used for personal hygiene both in the United States and internationally. Users of bidets champion the use of water to cleanse the body in lieu of paper tissue.

Traditional bidets can be expensive. Since most traditional households in the United States are not built with bidets, there is considerable cost to re-plumb a bathroom.

Traditional bidets are also not intuitive to most users in the United States. Users generally do not know how to sit and adjust the flow of water for proper cleansing. For guests that visit homeowners with bidets, this can lead to embarrassing moments when homeowners must explain its use.

Traditional bidets consist of a ceramic bowl with a fountain fixture located in the middle of the bowl. The user depresses a paddle or turns a knob on the side of the bowl, causing water to be sprayed upwards with a moderate force. The user can regulate the force of spray by adjusting the paddle on the side of the bowl.

The aesthetic design of traditional bidets is evidenced by recent issued Design Patents; D486894 to Garza, D484579 to Bennie, and D476401 to Palacin. These designs demonstrate traditional approaches to this method of personal hygiene.

The high cost and limitations of installing a traditional bidet as a separate plumbing fixture has been recognized. A design by McMurdo (Pub No.: U.S. 2003/0220620 A1) has a self contained water supply which is applied by squeezing a collapsible vessel.

Other designs are located or integrated with a standard toilet. These include a spraying device mounted at the rear end of a toilet bowl by Bass, Sr. (U.S. Pat. No. 4,926,509), and a design with the spraying located in the front portion of the bowl by Moshkovich (U.S. Pat. No. 6,397,406).

Other designs include flexible hoses that can be manipulated to clean specific areas. These include a two headed design by Krist (U.S. Pat. No. 5,720,055), a stream outlet design by Bell (U.S. Pat. No. 6,473,913), and a nozzle type sprayer assembly by Mueller (6,704,946).

Traditional bidets require separate fixtures for installation. This is an expensive process for most homes and leads people to look for alternate solutions.

The use of a squeeze bottle as a type of bidet (McMurdo) suffers from a limited water supply. Spraying devices mounted on the toilet bowl is an improvement (Bass, Sr.; Moshkovich), but is limited by the stationary aspects of the sprayer.

Although not directly related to bidet devices, several combined nozzle and sprinkler devices in the prior art may have general relevance the disclosed subject-matter. Typically, such devices are two-way devices, permitting either nozzle or sprinkler operation, and are attachable to a garden hose or the like. For example, U.S. Pat. No. 523,941, to North, et al., entitled Combined Sprayer and Nozzle, generally discloses a two-way valve-actuated sprinkler and nozzle device. The device may be hand-held or ground mounted by means of a stationary spike. The dangers inherent in such structure are obvious. Similarly, U.S. Pat. No. 1,031,176, to Gilpin, entitled Combined Nozzle, Sprayer, and Sprinkler, discloses a two-way valve, sprinkler/nozzle combination device wherein valve operation is actuated by manually extending and planting two spikes in the ground. U.S. Pat. No. 1,026,742, to French, entitled Combination Hose Nozzle and Sprayer, teaches a three-positional valve spraying device which may be actuated to a fully off position, a nozzle only position, and a sprayer only position. Other combination nozzle/sprayer devices rely upon relatively complex valve structure for operation. U.S. Pat. No. 623,057, to Wentz, entitled Combined Nozzle and Sprayer; and U.S. Pat. No. 1,612,326, to Taylor, entitled Garden Hose Attachment, also rely on rather complex valve structure to actuate their respective spray heads.

Additionally, spray-cleaning devices are known to employ variable spray nozzles and also to use a dispenser for containing and dispensing soaps of other cleaning agents. There are numerous issued patents directed to dispensers having variable discharge patterns. A dispenser of a relevant type may be a relatively low-cost, hand-held device which may be operated by pulling the trigger to pump a liquid substance from the interior of a container attached to the dispenser and through a nozzle at the front of the dispenser. Dispensers of this general type have a variety of features which have become well-known in the industry. For example, many of these dispensers include a horizontally aligned or an inclined pump which may be actuated using a trigger pivotally attached to the dispenser housing. This type of dispenser is frequently referred to as a trigger sprayer. Another type of dispenser has a vertically reciprocating pump which may be actuated with the index finger to dispense liquid as a stream or a spray. This type of dispenser is frequently referred to as a finger type pump. Still another type of dispenser comprises a container and a manually operated valve where the fluid contents of the container are pressurized. When the valve is opened, the fluid is dispensed. This type of fluid dispenser is frequently referred to as an aerosol dispenser. Such sprayers and dispensers are known to be useful for cleaning purposes.

The current class of personal-cleansing (bidet) devices, however, suffer from various limitations, and most designs only spray water (Krist, Bell, and Mueller), which may clean, but does not sanitize.

It is therefore an object of the invention to provide and inexpensive and easy-to-retrofit device for personal cleaning. It is another object of the invention to allow soap, cleaners, antiseptic or antibacterial agents to be applied in conjunction with the personal cleansing process.

SUMMARY OF THE INVENTION

The present invention provides a personal cleansing device that is low in cost, simple to manufacture from standard components, and provides cleaning capabilities with water, and optionally a soap or antiseptic solution. The applicant wishes to strongly emphasize that the prior-art appliances and devices have not found popular acceptance in home and retail use due to impracticality of use and manufacture, their high cost, and the necessity for expert installation. The only option commonly offered is the very expensive, classic bidet device. There is clearly a need for a personal cleaning device that can be easily retrofitted to the pre-exiting plumbing of a toilet and that is easy and inexpensive to manufacture, install and use.

The personal cleansing device of the invention comprises a spray nozzle with a manually activated trigger mechanism integrated within the spray nozzle body. The spray nozzle is mounted at the end of a flexible tube which tube is attached in fluid communication with a water supply. The attachment point between the flexible tube and the water supply may include a standard T-junction pipe fitting with an optional integrated valve mechanism, such as a traditional screw valve. The personal cleansing device additionally may include a reservoir for containing and dispensing a cleaning or disinfecting liquid, or other type of liquid. The reservoir is in fluid communication with the spray nozzle by a delivery tube. Fluid from the reservoir may be forced through the delivery tube towards the spray nozzle by various means such as the use of a vacuum, or the Venturi effect. The invention encompasses a number of optional embodiments having various elements attached at or near the spray nozzle. Such optional elements may include a light source, a cleaning brush or sponge, an air blower device and may optionally include mirrors or other viewing devices.

In certain embodiments, the invention includes a water branch off valve which is installed in flowable relation with the water supply line of a standard toilet. This valve supplies water to a flexible hose of approximately three foot (3 ft) in length. This hose may be a retractable hose. This hose is connected to a manually operated sprayer that comprises a sprayer housing and preferably a trigger mechanism that may be used to turn on or off the delivery of water.

An integral soap/cleanser/antiseptic container and dispenser may additionally be present and may be connected to the sprayer so as to dispense a fluid to the sprayer and into the stream of water to be delivered. A separate trigger mechanism may be included in the sprayer housing to turn on and off the delivery of soap/cleanser/antiseptic.

Additional and optional components may also be included. For example the device may include a spray pattern adjuster used to alter the spray pattern of the delivered fluid. Such a spray pattern adjuster may comprise a slidable template or a trigger-adjustable nozzle such as are commonly used in a garden hose sprayer. The device may include, integrated into the sprayer housing, a light source and a lens for assisting in visualization of a target area; a mirror for viewing a target area; an air-blower element for blowing air and drying; and brush and/or sponge attachments for enhanced cleaning.

BRIEF DESCRIPTION OF THE DRAWINGS

A complete understanding of the present invention may be obtained by reference to the accompanying drawings.

DESCRIPTION OF THE EMBODIMENTS

Figure 1:
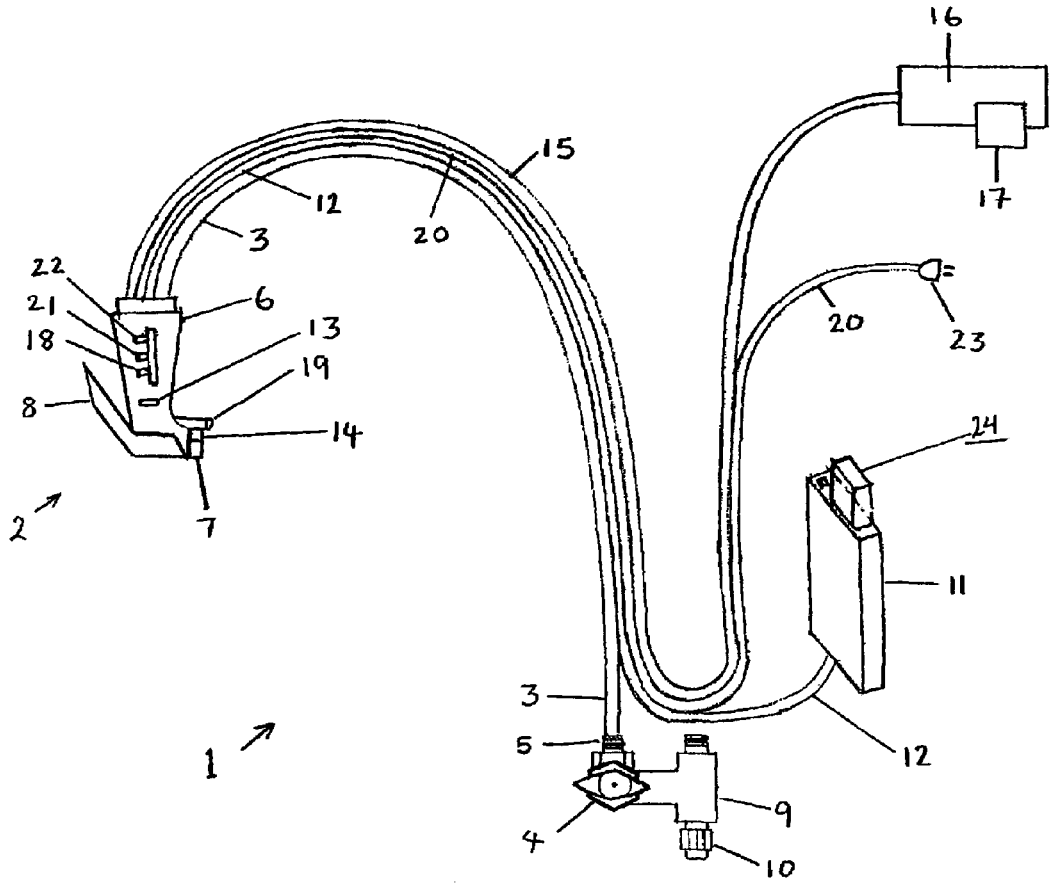
FIG. 1 is a schematic external representation of the personal cleansing device (1) showing the sprayer (2), the sprayer housing (6), the sprayer nozzle (7), the sprayer trigger (8), the flexible hose (3), the hose attachment point (5), the threaded nut (10) and the T-junction connection (9). Various optional elements are also shown including a reservoir (11) that may be used to contain and dispense soap or other fluids and that may be attached to the side of a toilet tank or to the wall; a soap delivery tube (12) that fluidly connects the reservoir with the sprayer; an attachment mount (13) for optional attachments; and an air-blower device comprising an air pump (16), an optional air heater element (17) and a hot-air control switch (21), an air conduit (15), an air outflow element (14) integrated into the end of the nozzle (7); and an air outflow switch (18). Additionally shown is an optional light (19) that may be mounted on the sprayer housing; an electrical conduit (20) that supplies power to the light, a plug (23) and a light switch (22).

Referring to the drawings, the personal cleansing device is generally shown in FIG. 1.

It should be noted that although the exemplary device of FIG. 1 includes various optional features such as an air-blower, a light source, and other attachments, the basic device does not require any or these optional elements and in its simplest form consists of a flexible hose and a sprayer nozzle with a trigger mechanism wherein the flexible hose is plumbed into the water supply pipe via a simple T-junction.

In one embodiment, a the flexible hose (3) is provided that has a proximal end connected to the water supply pipe, and a distal end, terminating in a sprayer apparatus. The flexible hose is attached at the proximal end to the water supply pipe via a standard T-junction connection using conventional plumbing means. For example, a threaded brass, copper or galvanized tubular fitting may be employed with threaded connection fittings to allow fluid-tight connection to other pipes. The flexible hose may be made form any number of materials that are sufficiently flexible and hard-wearing to allow easy manipulation and positioning of the device when in use. Such materials include, for example polyvinylchloride (PVC), polytetrafluoroethylene (PTFE), polypropylene, polyethylene, polyester or polyamide or other plastics or acrylics or rubber or latex materials. The length of the flexible hose may be variable from perhaps two foot to six or seven feet, depending on the desires location and mode of use. A typical length may be two to three feet for use with a toilet. If shower use is desired, a longer hose may be used.

The flexible hose distal end terminates in a sprayer apparatus, designed and adapted for manual use. The sprayer apparatus consists of a sprayer housing (6), a sprayer trigger (8) and a sprayer nozzle (7). The sprayer housing contains a sprayer mechanism that may be of any conventional type incorporating a manually-actuated valve mechanism. The sprayer mechanism generally includes a valve that has an open position and a closed position. Certain valves provide a continuously variable flow rate adjusted by the pressure exerted on the valve trigger. Continuously adjusting valves are adjustable between a fully closed and a fully open (patent) position. Cross-sectional flow area and pressure may be continuously adjusted from the "off" to the maximum flow setting. Spring-biased plunger-type valves and screw-type valves are commonly available types of valve that may be used with the sprayer mechanism of the disclosed invention. Any valve type may be used with the present invention so long as it functions to stop and start the flow of water through the sprayer.

The valve mechanism of the spray nozzle may be activated via a trigger disposed on the outside of the sprayer housing. The trigger may be a sprung lever-type trigger as generally shown in the exemplary figures, or may be a push-button or screw-type trigger mechanism. The trigger mechanism communicates with the valve mechanism, for example by depressing the plunger in a plunger-type valve. A sprung lever-type trigger has the advantage of being able to supply an infinitely-variable number of positions which may correspond to an equal number of flow-rates.

The sprayer housing is generally fabricated from moulded plastic and/or metal using a traditional form mould. Injection moulding is a commonly used fabrication technique that may be used with the present invention. The sprayer housing is designed and adapted to be hand-held and to incorporate a trigger mechanism. The housing may optionally include a moulded, shaped and/or rubberized grip for ease of use.

Although the examples describe a hand-held sprayer unit, the invention also encompasses a sprayer unit that may be fixed at a certain position for hands-free use. In such an embodiment the sprayer may be fixed and mounted on an immovable object such as on the rim of a toilet-bowl or upon the side of a bath-tub. A means of fixing may be provided, for example a spring-biased clamp of hook, or a suction-cup mounted universal joint clamp which, for example, could be removably fixed to the wall of a shower stall, and set in a desirable position for convenience of use.

The flexible hose proximal end is connected to the main water supply pipe via a T-junction fitting. The T-junction connection may incorporate a traditional screw valve (4) and a manually operated knob (14) that opens and closes the valve. A compression nut fitting (10) may be used to fit the T-junction to the main water supply pipe.

Optional elements include a reservoir (11) that may be used to store and dispense soap or other fluids. A soap delivery tube (12) fluidly connects the reservoir with the sprayer. The reservoir may be a container made from any number of materials such as hard plastics, such as PTFE. The reservoir is not limited to containing and dispensing soap, but may contain and dispense any desired fluid such as antiseptics, antibiotics, fragrances, medicines or any combination of the above. The reservoir may be pressurized by means of a pre-pressurized gas system or by means of a mechanical pump that can be operated manually or electrically (24). By use of pressure, the fluid contained in the reservoir is forced through the soap delivery tube (12) to the nozzle, where it is injected into the water stream and projected from the nozzle to the desired target. The soap or other liquid may be introduced into the water stream by any standard means that may or may not involve pre-dilution.

Figure 2:
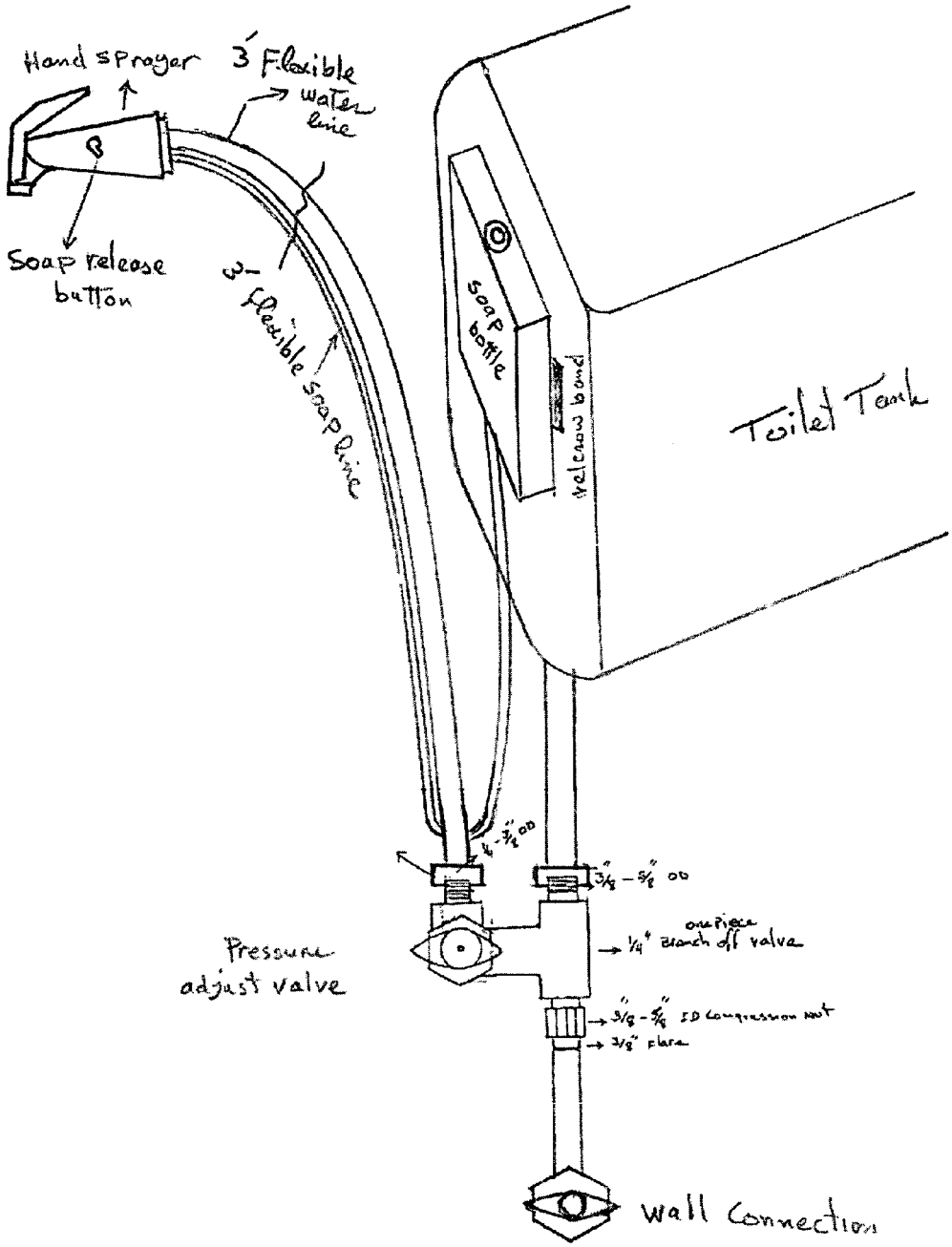
FIG. 2 is a graphic representation of a simple embodiment of the personal cleansing device employing a flexible water line and a soap line attached to a hand sprayer. In this embodiment the soap dispenser is shown attached to the side of a toilet tank.
Figure 3:
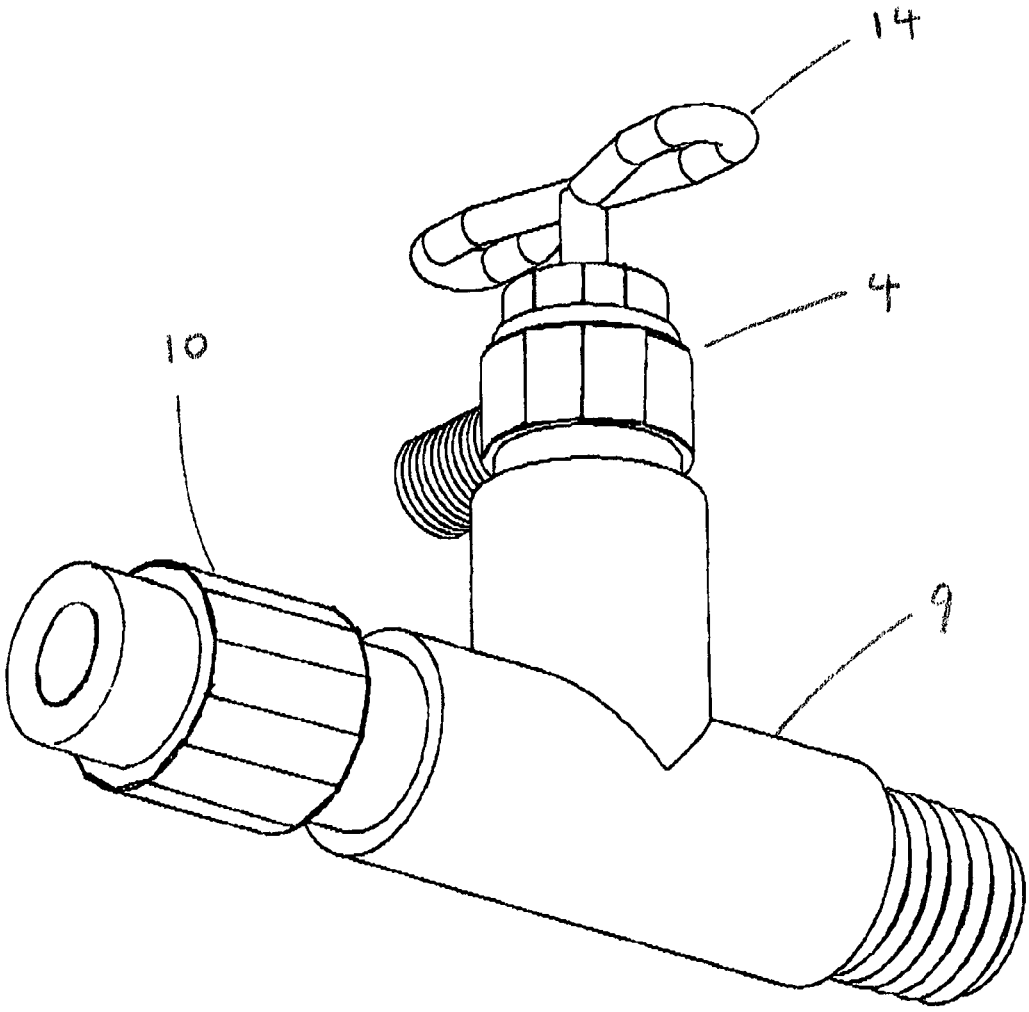
FIG. 3 is a schematic external representation of the T-junction connection (9) incorporating a screw-type valve (4) further showing a knob (14) and a compression nut (10) which is used to securely connect the T-junction connection to the water supply pipe.

FIG. 2 shows the soap reservoir attached to the side of a toilet tank.

A preferred fluid to be contained within the reservoir is a soap suspension, but may also include any number of beneficial and desirable substances such as antibiotics, antiseptics, drugs, fragrances and moisturizers.

The soap delivery tube (12) (which may conduct and deliver any fluid, not just soap) may be of variable lengths, and although shown of a certain relative length in the exemplary figures, the delivery tube may be very short, for example only a few inches. This may be particularly desirable in certain embodiments where a shorter delivery tube would facilitate delivery of a soap or other solution. For example, in an embodiment where a partial vacuum is used to draw the soap into the water stream, a shorter delivery tube would help reduce the overall resistance in the delivery tube, especially if the soap solution of other fluid has a relatively high viscosity. In such an embodiment, the soap delivery tube may be just an inch or two in length and the reservoir may be positioned at or close to the distal end of the flexible hose. Alternatively the reservoir may be incorporated within the sprayer housing. Such an embodiment may additionally have cosmetic advantages with fewer hoses visible to the user.

Various other optional elements include an attachment mount (13) for attachments. Such attachments may include, for example a mirror for viewing a target area, or a brush or a sponge for cleaning. Such elements may be removeably attached to the attachment mount and used as desired, or may be permanently fixed to the attachment mount. The sponge an brush attachments may be disposable.

Another optional embodiment includes a light source (19) and electrical conduit (20) to transmit power to the light source. In various embodiments the light source may be mounted on the sprayer nozzle body. Alternatively the light may be produced by a light source distal to the proximal end of the flexible hose, and the light may be transmitted via a fibre-optic cable. Suitable light sources include incandescent and light emitting diode (LED) lights.

Other embodiments include an air-blower device having an air pump (16), an optional air heater element (17), an air conduit (15), an air outflow element (14) and an air outflow switch (18). The air pump may be, for example, a simple mechanical blower fan such as is commonly used in a hair dryer. The heater element may likewise be of standard construction. The air conduit may be a flexible tube of any suitable construction, and the air outflow element may be a simple nozzle of any design. The air outflow switch is preferable an electrical switch of a traditional circuit-breaking type that will switch on or off the air pump (16).

An important advantage of the present device is that it is constructed from standard parts and is therefore easy and inexpensive to manufacture. Additionally it is simple to install by retrofitting it to a standard toilet water system. These advantages make the present invention particularly attractive to manufactures, marketers and buyers. Additionally, the simplicity of the present invention, unlike other bidet devices, makes the device reliable and suitable for maintenance-free use for many years.

The instillation of the present invention may be accomplished by a person with even the most basic plumbing tools and skills. First, the water flow through the toilet water supply must be shut off using the shut-off valve below the toilet tank, and the water supply pipe is unscrewed. Then the compression nut of the T-conection is unscrewed and the nut at the flared part of the T-Valve is screwed onto the toilet shut-off valve. Making sure that the T-valve is shut, the toilet shut-off valve is gradually opend and the in-line nuts are tightend. Then, holding the sprayer in hand and towards the toilet bowl, the T-valve is gradully opend and the desired pressue at the sprayer is obtaind by pressing the sprayer handle. A hook designed for the T-Valve, may be attached to the wall or toilet tank to reatin the sprayer handle when not in use.

In use, the personal cleansing device of the invention may be used with the toilet or with a shower or bath, depending on the length of the flexible hose.

Various modifications that may be made to fit particular operating requirements and environments will be apparent to those skilled in the art. The invention is not considered limited to the example chosen for purposes of disclosure, and covers all changes and modifications which do not constitute departures from the true spirit and scope of this invention.

What is claimed is:

1. A personal cleansing system comprising:

a personal cleansing device, the device comprising a sprayer handle element having an integrated trigger mechanism, a flexible tube having a proximal end and a distal end, wherein the distal end is directly connected to the sprayer handle element, and a T-conjunction fitting having one inlet and two outlets, the inlet connected to a water supply pipe, a branch-off valve integrally formed at one of the outlets, the branch-off valve having an open position and a closed position, wherein the branch-off valve is directly connected to the proximal end of the flexible tube, wherein, when the branch-off valve is in the open position, a fluid pathway is present between the water supply pipe, the branch-off valve, the flexible tube and the sprayer handle element, a reservoir located exterior to the sprayer handle element and a delivery tube, the delivery tube having two ends, wherein one end of the delivery tube is directly connected to the interior of the reservoir and the other end of the delivery tube is directly connected to the sprayer handle element, and a pressure-creating means for creating pressure within the reservoir, wherein the pressure-creating means comprises a pressurized gas cylinder, or a pump.

2. The personal cleansing system of claim 1 further comprising a cleansing fluid within the reservoir.

3. The personal cleansing system of claim 1 further comprising an antiseptic fluid within the reservoir.

4. The personal cleansing system of claim 1 further comprising a fragranced fluid within the reservoir.

5. The personal cleansing system of claim 1 further comprising an air-blower device wherein the air-blower device comprises an air pump, an air conduit attached to the air pump and an air outflow element attached to the air conduit, wherein the air outflow element is attached to the sprayer handle element.

6. The personal cleansing system of claim 1 further comprising a mirror attached to the sprayer handle element.

7. The personal cleansing system of claim 1 further comprising a light source attached to the sprayer handle element.

8. The personal cleansing system of claim 1 further comprising a brush or sponge attached to the sprayer element.

9. The personal cleansing system of claim 1 further comprising a light source attached to the sprayer handle element.

10. The personal cleansing system of claim 1 wherein the sprayer handle element comprises a sprayer housing, a sprayer trigger and a sprayer nozzle, and wherein the flow rate of a liquid passing through the sprayer nozzle is continuously variable and varies in relation to the pressure exerted on the sprayer trigger.

* * * * *